US009457218B2

(12) United States Patent
Oh

(10) Patent No.: US 9,457,218 B2
(45) Date of Patent: Oct. 4, 2016

(54) WHOLE BODY EXERCISE DEVICE

(71) Applicant: OVERTECH CO., LTD., Anyang-si, Gyeonggi-do (KR)

(72) Inventor: Seung Hoon Oh, Bucheon-si (KR)

(73) Assignee: OVERTECH CO., LTD., Gyeonggi-Do (KR)

( * ) Notice: Subject to any disclaimer, the term of this patent is extended or adjusted under 35 U.S.C. 154(b) by 316 days.

(21) Appl. No.: 14/361,272

(22) PCT Filed: Nov. 28, 2012

(86) PCT No.: PCT/KR2012/010144

§ 371 (c)(1),
(2) Date: May 28, 2014

(87) PCT Pub. No.: WO2013/081362

PCT Pub. Date: Jun. 6, 2013

(65) Prior Publication Data

US 2014/0329652 A1 Nov. 6, 2014

(30) Foreign Application Priority Data

Nov. 28, 2011 (KR) ..... 10-2011-0125219

(51) Int. Cl.

| | |
|---|---|
| ***A63B 21/00*** | (2006.01) |
| ***A63B 21/005*** | (2006.01) |
| ***A61H 1/02*** | (2006.01) |
| ***A61H 15/00*** | (2006.01) |
| ***A63B 23/04*** | (2006.01) |
| ***A63B 23/08*** | (2006.01) |

(52) U.S. Cl.

CPC ..... *A63B 21/0058* (2013.01); *A61H 1/0237* (2013.01); *A61H 1/0292* (2013.01);
(Continued)

(58) Field of Classification Search

CPC ..... A63B 21/00
USPC ..... 482/146, 148, 142
See application file for complete search history.

(56) References Cited

U.S. PATENT DOCUMENTS

| | | | | |
|---|---|---|---|---|
| 7,357,768 | B2 * | 4/2008 | Marshall | A61H 1/0255 482/142 |
| 2008/0254954 | A1 | 10/2008 | Kim | |
| 2014/0100093 | A1 * | 4/2014 | Oh | A61H 1/001 482/146 |

(Continued)

FOREIGN PATENT DOCUMENTS

| | | |
|---|---|---|
| KR | 1020100008082 | 1/2010 |
| KR | 1020110105413 | 9/2011 |
| KR | 101070813 | 10/2011 |

*Primary Examiner* — Jerome W Donnelly
(74) *Attorney, Agent, or Firm* — IPLA P.A.; James E. Bame

(57) ABSTRACT

A whole body exercise device comprises an upper body exercise part which comprises an upper body support which supports the upper human body, a mat fixing plate which is disposed at an upper surface of the upper body support, a link which is disposed at one side of a lower surface of the upper body support, a rotary shaft which is disposed at the lower surface of the upper body support for a seesaw motion, a crank cam rod which is disposed between the link and a driven shaft pulley, a main shaft pulley which is connected to the driven shaft pulley by a power transmission part, and a driving shaft pulley which is connected by the power transmission part to the main shaft pulley and a motor; and a waist and hip exercise part which comprises a hip support which supports a hip, a height adjustment cylinder which is connected to a lower end of the hip support, a guide, a rail, a power transmission motor for the parallel movement, a reciprocating rotation crank rod, a cam whose one end is connected to the reciprocating rotation crank rod and whose other end is connected to the main shaft pulley through the rotation axis, and a pulley bracket whose one end is connected to the main shaft pulley through the rotation axis and whose other end is fixed to a lower end of a main frame.

4 Claims, 7 Drawing Sheets

(52) U.S. Cl.
CPC ..... *A61H15/0078* (2013.01); *A63B 21/155* (2013.01); *A63B 23/04* (2013.01); *A63B 23/08* (2013.01); *A61H 2015/0035* (2013.01); *A61H 2201/1215* (2013.01); *A61H 2203/0462* (2013.01); *A63B 2208/0242* (2013.01)

(56) References Cited

U.S. PATENT DOCUMENTS

2016/0022039 A1* 1/2016 Paul ..... A47C 1/0342 297/88

* cited by examiner

WHOLE BODY EXERCISE DEVICE

BACKGROUND

The present invention relates to a whole body exercise device in which a rotational motion and an up-and-down motion of each part of a human body are linked to each other to strengthen the upper body, the waist, and the lower body.

With advancement of the modern society, people are at risk of various diseases due to insufficient exercise and hyperingestion.

Particularly, due to a strained posture, overwork or aging, the human body is exposed to degenerative lumbar disk diseases occurring in the waist, the back, the abdomen, or the knees, scoliosis that the spine is curved, fascial pains in the hip joint and waist parts, degeneration in growth due to stress, oversized stomach, and others. Therefore, in order to solve the above problems, people do exercises for a long time, and have help from various exercisers or from professional trainers.

According to such a trend, lots of exercisers for strengthening each part of the body or strengthening the whole body have been released and developed.

For instance, exercisers of various kinds, such as cervical spinal exercisers, abdominal exercisers, electronic leg joint exercisers, lower body exercisers, aerobic exercisers, spine correction exercisers, boxing game exercisers, pelvic muscle exercisers, body type exercisers for the whole body, back acupressure exercisers, grasping power exercisers, shoulder twisting exercisers, multi-purpose exercisers, total-body exercisers, and others, have been used and developed.

In spite of the great deal of exercisers, it is clear that more convenient, effective and efficient exercisers would be continuously developed and used.

SUMMARY OF THE INVENTION

Accordingly, the present invention has been made in an effort to solve the above-mentioned problems occurring in the prior arts, and it is an object of the present invention to provide a total-body exerciser capable of making the human body's waist, abdomen and knee joints flexible and strengthening muscular strength.

It is another object of the present invention to provide a total-body exerciser capable of strengthening muscular strength, removing abdominal fat, strengthening flexibility and functions of internal organs, and enhancing mental relaxation effect so as to solve the problems of degenerative lumbar disk diseases of the middle-aged and the old-aged, scoliosis due to bad life habits, fascial pains in the hip joint and waist parts, and degeneration in growth due to stress of adolescent generation.

It is a further object of the present invention to provide a total-body exerciser which allows a user to do exercise of the upper body, the waist, the knee joints and the ankles in link with one another in a state where the user lays down on the exerciser comfortably according to movements of the exerciser.

To achieve the above objects, the present invention provides a total-body exerciser including: an upper body exercising part which includes an upper body support for supporting the upper body of a human body, a mat fixing plate disposed at an upper face of the upper body support, a link disposed at one side of a lower face of the upper body support, a rotary shaft disposed at the lower face of the upper body support for a seesaw motion, a crank cam rod disposed between the link and a driven shaft pulley, a main shaft pulley connected to the driven shaft pulley by a power transmission unit, and a driving shaft pulley connected to the main shaft pulley and a motor by the power transmission part; and a waist and hip exercising part which includes a hip support for supporting hips, a height-adjustable cylinder connected to a lower end of the hip support, a guide connected to an upper face of the hip support, a rail disposed at an upper carrying support enabling a parallel movement of the guide, a power transmission motor for the parallel movement, a reciprocating rotational crank rod connected to a lower end of the height-adjustable cylinder via a cam rod bracket, a cam of which one end is connected to the reciprocating rotation crank rod and of which the other end is connected to the main shaft pulley through the rotary shaft, and a pulley bracket of which one end is connected to the main shaft pulley through the rotary shaft and of which the other end is fixed to a lower end of a main frame.

Here, the total-body exerciser further includes a leg exercising part which includes a lower massaging roller serving to support the legs and provide a massaging function, an upper massaging roller which comes into contact with upper portions of the legs in order to massage the legs together with the lower massaging roller and which is mounted on an upper massaging roller support, a leg support post for supporting the lower massaging roller, a reciprocating link rod connected to a lower end of the leg support post, rotational cams connected to right and left sides of the reciprocating link rod, a fixing bracket of which one end is connected with the rotational cam via the rotary shaft and of which the other end is fixed to a lower end of the main frame, and a cam of which one end is connected to one end of the fixing bracket via the rotary shaft and of which the other end is connected with the reciprocating rotational crank rod.

Here, the total-body exerciser further includes an ankle exercising part which includes an ankle support mat for supporting ankles, an ankle rotating plate support for holding the ankle support mat, a rotary shaft fixing plate connected with the ankle rotating plate support by a rotary shaft, and a rotation stopping bar adapted to prevent that the ankle support mat is completely rotated and falls backward to the opposite side by the ankle rotating plate support in the state where a user lays down on the exerciser.

Here, a gripper fixing bracket having a gripper is connected to one end of the mat fixing plate, and an auxiliary waist support is connected to the other end of the mat fixing plate and is also connected with the hip support.

According to an embodiment of the present invention, the total-body exerciser can make the human body's waist, abdomen and knee joints flexible and strengthening muscular strength. Additionally, the total-body exerciser can strengthen muscular strength, remove abdominal fat, strengthen flexibility and functions of internal organs, and enhance mental relaxation effect so as to solve the problems of degenerative lumbar disk diseases of the middle-aged and the old-aged, scoliosis due to bad life habits, fascial pains in the hip joint and waist parts, and degeneration in growth due to stress of adolescent generation.

Figure 1:
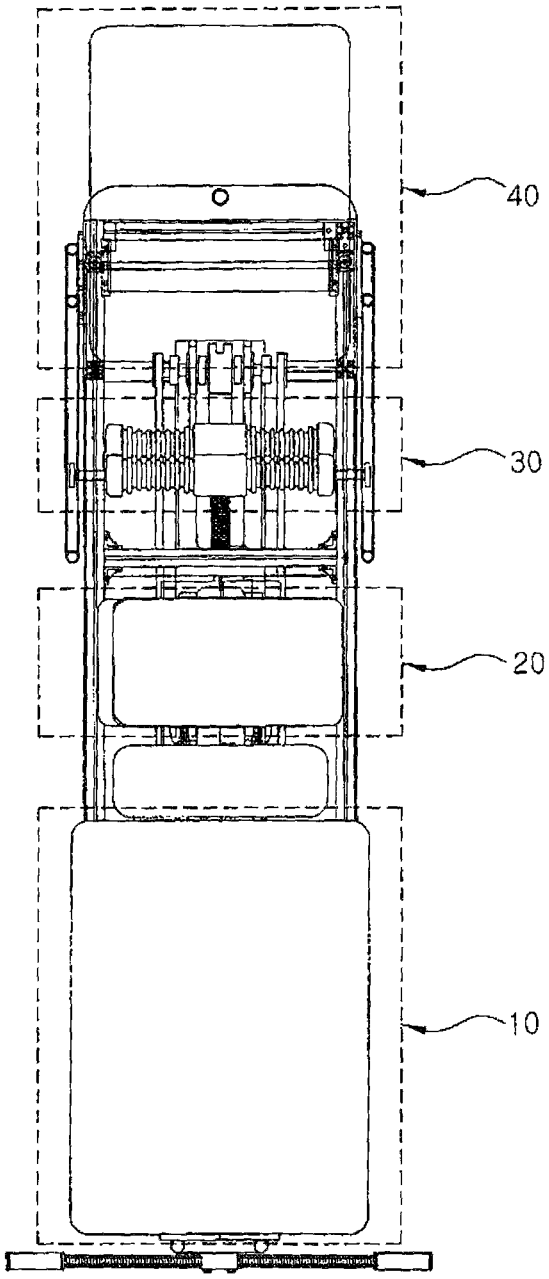
FIG. 1 is a plan view of a total-body exerciser according to a preferred embodiment of the present invention.

<Explanation of essential reference numerals in drawings>

10: upper body exercising part
20: waist and hip exercising part
30: leg exercising part
40: ankle exercising part
50: main frame
101: upper body support
102: rotary shaft
103: link
104: safety spring
105: upper body support mat
106: fixing bracket
107: gripper
108: mat fixing plate
109: auxiliary frame
110: driving shaft pulley
111: main shaft pulley
112: driven shaft pulley
113: power transmission unit
114: reducer
201: auxiliary waist support
202: reciprocating link shaft
203: height-adjustable cylinder
205: hip support
206: guide
207: rail
208: upper carrying support
209: hip support mat
210: motor-and-reducer
213: reciprocating rotational crank rod
301: leg support post
302: height-adjustable lever
303: lower massaging lever
304: upper massaging roller
305: hand-grip
307: safety spring
308: reciprocating link rod
309: rotational cam
310: cam
311: fixing bracket
312: reciprocating rotational crank rod
316: emergency spring
319: spring holder
401: ankle support mat
402: rotary shaft
403: rotation stopping bar
404: ankle rotating plate support
405: rotary shaft fixing plate

DETAILED DESCRIPTION OF THE INVENTION

The present invention relates to a total-body exerciser including: an upper body exercising part which includes an upper body support for supporting the upper body of a human body, a mat fixing plate disposed at an upper face of the upper body support, a link disposed at one side of a lower face of the upper body support, a rotary shaft disposed at the lower face of the upper body support for a seesaw motion, a crank cam rod disposed between the link and a driven shaft pulley, a main shaft pulley connected to the driven shaft pulley by a power transmission unit, and a driving shaft pulley connected to the main shaft pulley and a motor by the power transmission part; and a waist and hip exercising part which includes a hip support for supporting hips, a height-adjustable cylinder connected to a lower end of the hip support, a guide connected to an upper face of the hip support, a rail disposed at an upper carrying support enabling a parallel movement of the guide, a power transmission motor for the parallel movement, a reciprocating rotational crank rod connected to a lower end of the height-adjustable cylinder via a cam rod bracket, a cam of which one end is connected to the reciprocating rotation crank rod and of which the other end is connected to the main shaft pulley through the rotary shaft, and a pulley bracket of which one end is connected to the main shaft pulley through the rotary shaft and of which the other end is fixed to a lower end of a main frame.

Reference will be now made in detail to the preferred embodiment of the present invention with reference to the attached drawings.

Figure 2:
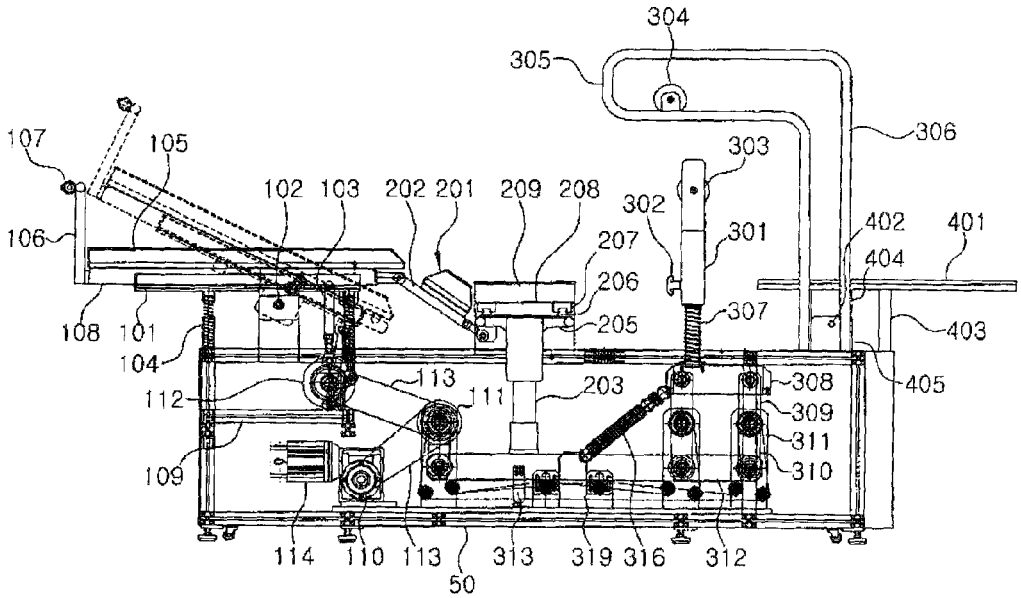
FIG. 2 is a front view of the total-body exerciser.
Figure 3:
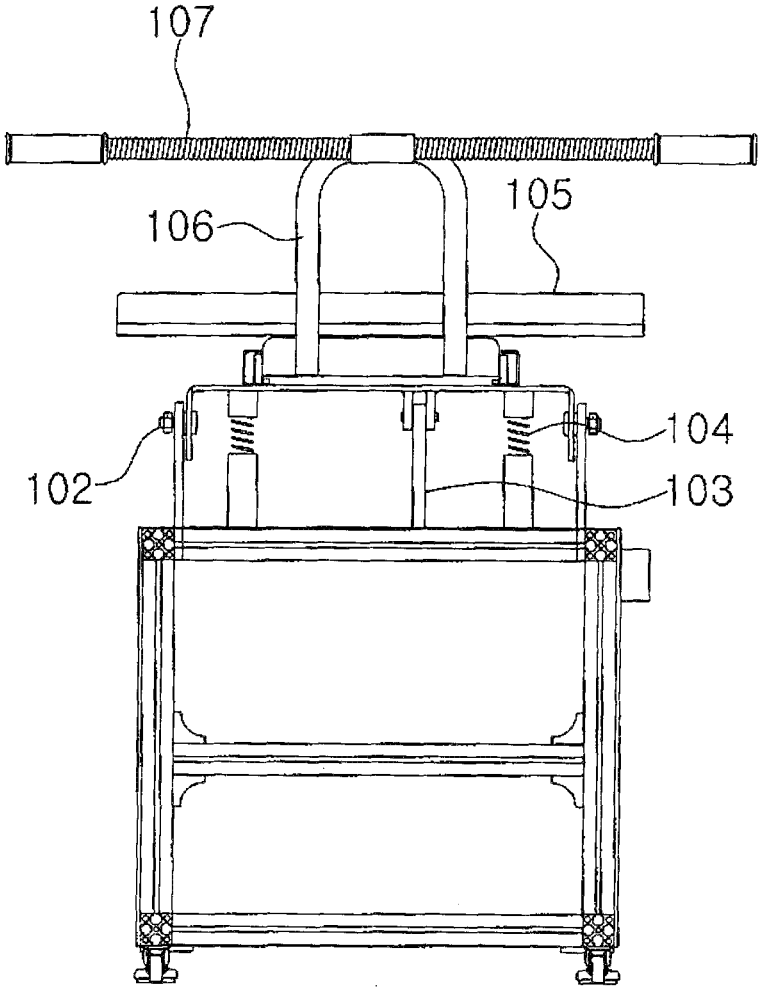
FIG. 3 is a left side view of the total-body exerciser.
Figure 4:
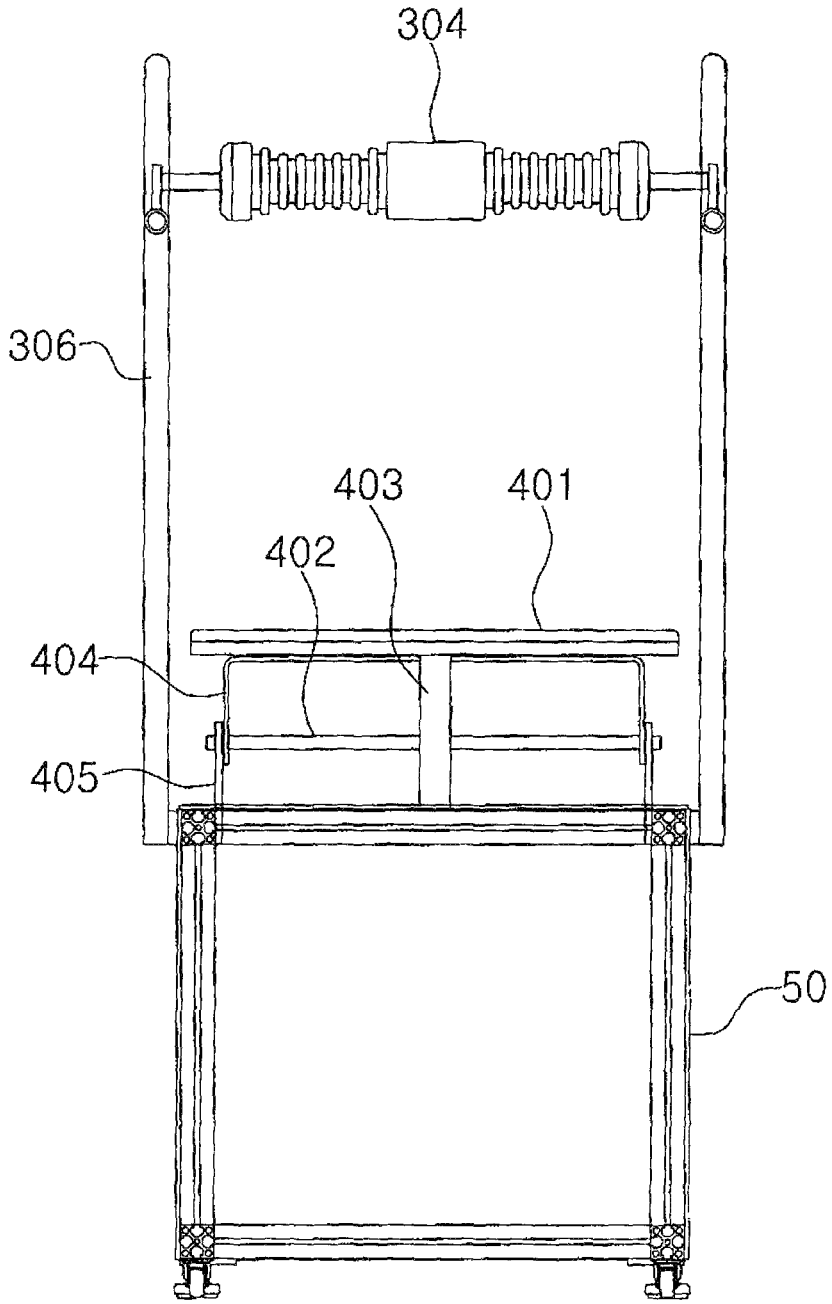
FIG. 4 is a right side view of the total-body exerciser.

FIG. 1 is a plan view of a total-body exerciser according to a preferred embodiment of the present invention, FIG. 2 is a front view of the total-body exerciser, FIG. 3 is a left side view of the total-body exerciser, and FIG. 4 is a right side view of the total-body exerciser.

As shown in FIGS. 1 to 4, the total-body exerciser according to the preferred embodiment of the present invention includes an upper body exercising part 10, a waist and hip exercising part 20, a leg exercising part 30 and an ankle exercising part 40, and the upper body exercising part 10, the waist and hip exercising part 20, the leg exercising part 30 and the ankle exercising part 40 are connected to a main frame 50.

The upper body exercising part 10 is a part to exercise the upper body from the head to the waist, and in this embodiment of the present invention, sit-up is applied to the upper body exercising part 10.

The waist and hip exercising part 20 includes an auxiliary waist support 201 which aids exercises of the upper body and the hips, and a hip support 205 which supports the hips and serves left and right motions and vertical, rotational and circular motions of the hips.

The leg exercising part 30 serves vertical, rotational and circular reciprocating motions and a massaging function by upper and lower massaging rollers 303 and 304.

The ankle exercising part 40 freely rotates according to directions of power, such that a user naturally locates the ankles when the user does exercises of the upper body, the waist, the hips and the legs.

Referring to FIGS. 2 to 4, the upper body exercising part 10 is subject to sit-up of the upper body, and includes an upper support 101, an upper support mat 105, a gripper 107, a mat fixing plate 108, an auxiliary frame 109, a driving shaft pulley 110, a main shaft pulley 111, and a driven shaft pulley 112.

The upper body support 101 is a part to support the user's upper body in the state where the user lays down on the exerciser. The lower portion of the upper body support 101 is connected by a link 103, the mat fixing plate 108 is put on the upper body support 101, and the upper body support mat 105 is formed on the mat fixing plate 108.

By the link 103 connected to one side of the upper body support 101, the upper body support 101 carries out a seesaw motion based on a rotary shaft 102.

In order to realize a natural seesaw motion, a safety spring 104 is formed between the lower end of the upper body support 1010 and the main frame 50.

The link 103 is connected to the driven shaft pulley 112 and the driven shaft pulley 112 is connected to the main shaft pulley 111 by a power transmission unit 113, the main shaft pulley 111 is connected to the driving shaft pulley 110 by the power transmission unit 113, and the driving shaft pulley 110 is connected to a motor-and-reducer 114, in order to transmit a driving power.

The upper body support mat 105 is joined to the upper side of the mat fixing plate 108, one end of the upper body support mat 105 has the gripper 107 formed by a gripper fixing bracket 106 and the other end is connected with the auxiliary waist support 201 for making the waist naturally move at the time of the exercise of the upper body.

Figure 6:
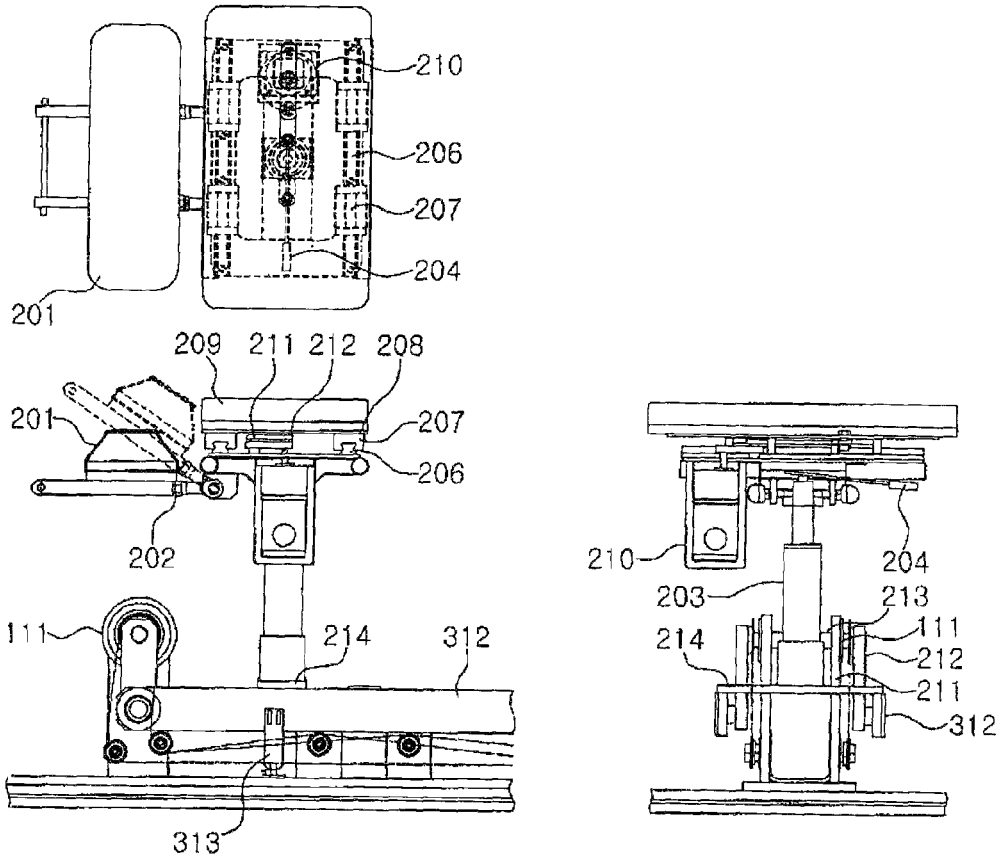
FIG. 6 is a view showing an operational mechanism of a hip exercising part of the total-body exerciser.

The waist and hip exercising part 20 includes an auxiliary waist support 201, a height-adjustable cylinder 203, a hip support 205, an upper carrying support 208, a hip support mat 209, and a motor-and-reducer 210 (See FIG. 6).

The auxiliary waist support 201 is a part to make the waist move naturally without any burden on the waist in link with the upper body exercise and the hip exercise, and one end of the auxiliary waist support 201 is connected to the mat fixing plate 108 of the upper body exercising part 10 by a reciprocating link shaft 202 and the other end is connected with the hip support 205.

A laterally leveling motion guiding unit for inducing a laterally leveling motion of the hip support mat 209 is disposed at the top of the hip support 205. The laterally leveling motion guiding unit includes a guide 206 formed on the upper face of the hip support 205 and rails 207 formed on the lower face of the upper carrying support 208.

The height-adjustable cylinder 203 is connected with the hip support 205 located above the cylinder 203 and is connected with a reciprocating rotational crank rod 213 located below the cylinder 203, such that the hip support 205 carries out the reciprocating rotational motion based on the reciprocating rotational motion of the reciprocating rotational crank rod 213.

The leg exercising part 30 is a part to carry out exercises of the knee joints and a massage of the legs in a state where the user puts the legs on the leg exercising part 30.

The leg exercising part 30 includes a leg support post 301, a lower massaging roller 303, an upper massaging roller 304, a reciprocating link rod 308, a rotational cam 309, a cam 310, and a fixing bracket 311.

The leg support post 301 supports the part on which the user's legs are put. The lower end of the leg support post 301 is connected with the reciprocating link rod 308 in a state where a safety spring 307 serving as a shover is fit to the lower end, and the lower massaging roller 303 for massaging the legs is mounted at the upper end of the leg support post 301. A height-adjustable lever 302 is formed at one side of the leg support post 301 in order to adjust the height of the leg support post 301.

The upper massaging roller 304 is located above the lower massaging roller 303 at a predetermined interval and is supported by the upper massaging roller support 306.

The upper massaging roller support 306 may have a hand-grip 305 formed at one end thereof.

A pair of the reciprocating link rods 308, a pair of the rotational cam 309, a pair of the cams 310 and a pair of the fixing brackets 311 are disposed at right and left of the leg exercising part 30, and they are connected with one another and is connected with 1 reciprocating rotational crank rod 312. The leg support post 301 interlocking with the reciprocating rotational crank rod 312 also carries out the reciprocating rotational motion in interlock with the hip support 205.

An emergency spring 316 is mounted between the reciprocating link rod 308 and the a spring holder 319 which is formed on the bottom face of the frame 50 in order to aid the reciprocating rotational motion of the reciprocating link rod 308.

The ankle exercising part 40 is a part to support the ankles, and includes an ankle support mat 401 for supporting the ankles, an ankle rotating plate support 404 for holding the ankle support mat 401, and a rotary shaft fixing plate 405 connected with the ankle rotating plate support 404 by a rotary shaft 402.

The rotary shaft fixing plate 405 rotatably supports the rotary shaft 402, and the lower portion of the rotary shaft fixing plate 405 is connected with the main frame 50.

The ankle rotating plate support 404 is freely rotated on the rotary shaft 402, so that a rotating plate is rotated according to power applied to the ankles at the time of the upper body exercise, the hip exercise and the leg exercise so as to make the ankles move naturally.

Here, in order to prevent that the ankle support mat 401 is completely rotated and falls backward to the opposite side by the ankle rotating plate support 404 in the state where the user lays down on the exerciser, a rotation stopping bar 403 is mounted.

Figure 5:
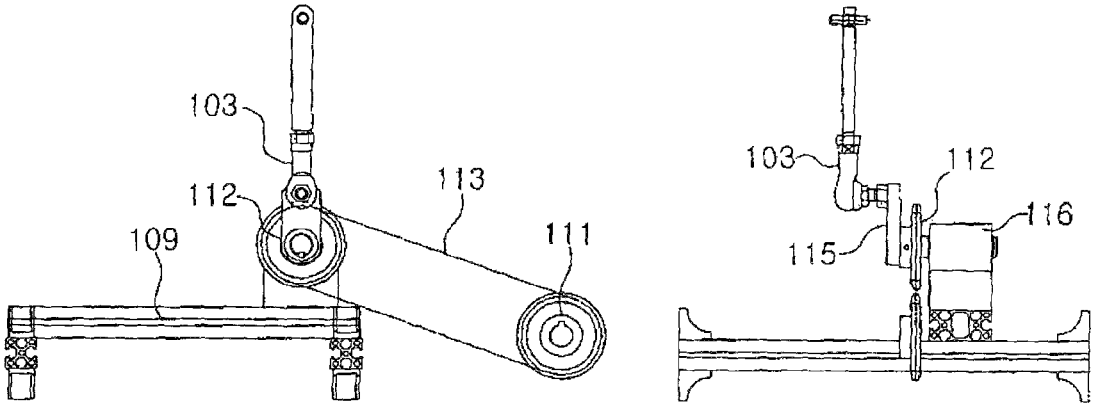
FIG. 5 is a view showing an operational mechanism of an upper body exercising part of the total-body exerciser.

FIG. 5 is a view showing an operational mechanism of an upper body exercising part of the total-body exerciser.

Referring to FIG. 5, the link 103 connected with the upper body support 101 is connected with the driven shaft pulley 112, the driven shaft pulley 112 is connected with the main shaft pulley 111 by the power transmission unit 113, the main shaft pulley 111 is connected with the driving shaft pulley 110 by the power transmission unit 113, and the driving shaft pulley 110 is connected to the motor-and-reducer 114.

Therefore, the driving power of the motor-and-reducer 114 is transmitted to the link 103 through the power transmission unit 113, the driving shaft pulley 110, the main shaft pulley 111 and the driven shaft pulley 112.

The link 103 receiving the driving power is connected with the driven shaft pulley 112 via a crank cam rod 115, and the crank cam rod 115 carries out the reciprocating rotational motion by the rotation of the driven shaft pulley 112 which receives the driving power, and the link 103 linked with the crank cam rod 115 carries out a vertical and rotational reciprocating motion.

The vertical and rotational reciprocating motion of the link 103 allows the user to carry out a seesaw motion, namely, a sit-up motion, while making the upper body support 101 do the seesaw motion based on the rotary shaft 102.

FIG. 6 is a view showing an operational mechanism of a hip exercising part of the total-body exerciser.

Referring to FIG. 6, the auxiliary waist support 201 is linked with the upper body support 102 and the hip support 205 via the reciprocating link shaft 202 so as to provide a natural up-and-down motion.

The hip support mat 209 is connected to the motor-and-reducer 210 by the guides 206, the rails 207 and the upper carrying support 208 which are formed on the hip support 205 in order to provide a laterally leveling reciprocating motion.

The lower end of the height-adjustable cylinder 203 is connected with the reciprocating rotational crank rod 312 via the cam rod bracket 214, the reciprocating rotational crank rod 312 is connected with the cam 212, one end of the cam 212 is connected with the reciprocating rotational crank rod 312 and the other end is connected to the main shaft pulley 111 through the rotary shaft 213, the main shaft pulley 111 is connected to a pulley bracket 211, and the pulley bracket 211 is fixed at the lower end of the main frame 50.

When the driving power is transmitted through the motor-and-reducer 114, the driving shaft pulley 110 and the main shaft pulley 111, the cam 310 connected thereto carries out the rotational reciprocating motion, the reciprocating rotational crank rod 312 connected with the cam 310 at one side also carries out the rotational reciprocating motion, and the height-adjustable cylinder 203 connected with the reciprocating rotational crank rod 312 via the crank rod bracket 214 also carries out the rotational reciprocating motion.

Figure 7:
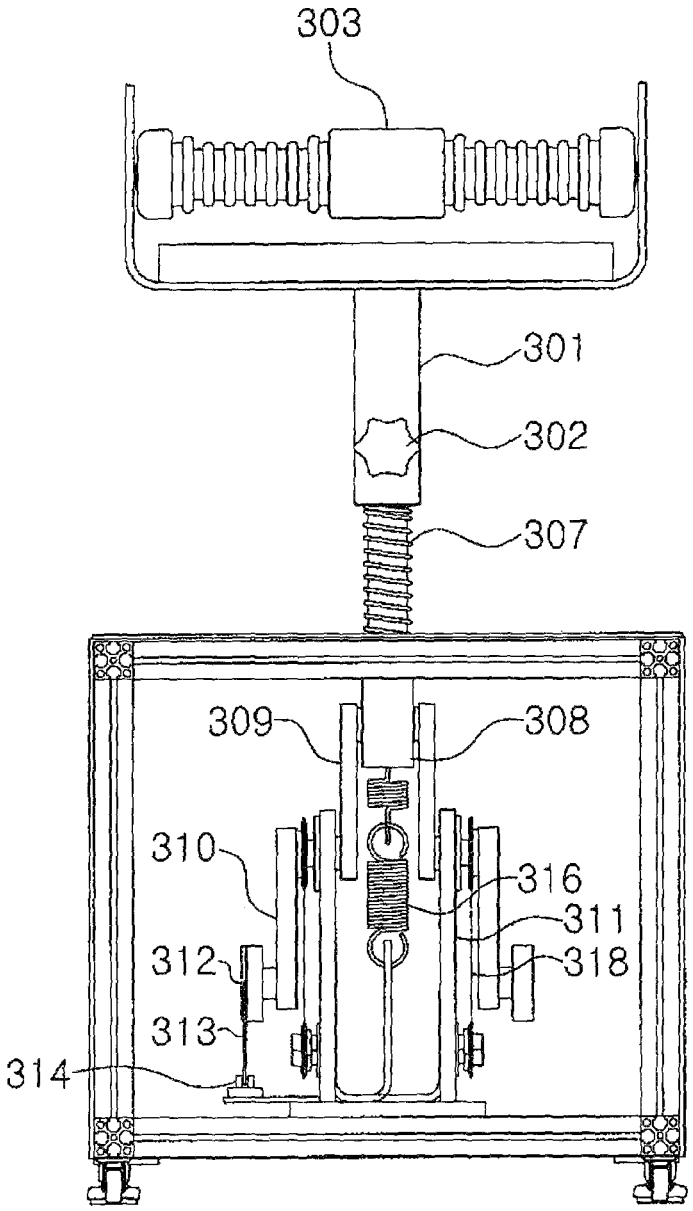
FIG. 7 is a view showing an operational mechanism of a leg exercising part of the total-body exerciser.

FIG. 7 is a view showing an operational mechanism of a leg exercising part of the total-body exerciser.

Referring to FIG. 7, the leg support post 301 is connected with the reciprocating link rod 308, the reciprocating link rod 308 is connected with the rotational cams 310 located at right and left sides, each of the rotational cams 309 is connected to one side of the fixing bracket 311 via the rotary shaft 319, the other side of the fixing bracket 311 is connected with the cam 310 via the rotary shaft 319, and the other end of the cam 310 is connected with the reciprocating rotational crank rod 312. The rotational cam 309 is connected to one side of one end of the fixing bracket 311 and the cam 3100 is connected to the other side, and the other end of the fixing bracket 311 is fixed to the lower end portion of the main frame 50.

The reciprocating rotational crank rod 312 which receives driving power from the motor-and-reducer 114, the power transmission unit 113, the driving shaft pulley 110 and the main shaft pulley 111 carries out the rotational reciprocating motion by the cam 310, and the rotational cam 309 connected with the cam 310 through the rotary shaft 319 carries out the rotational reciprocating motion.

In this instance, the rotational reciprocating motion of the rotational cam 309 induces the rotational reciprocating motion of the leg support post 301, and the reciprocating link rod 308 is interposed between the rotational cam 309 and the leg support post 301 in order to carry out the rotational reciprocating motion at the home position without any change in direction of the leg support post 301. By the reciprocating link rod 308, the leg support post 301 carries out the rotational reciprocating motion in interlock with the rotational cam 309 without changing the rotational direction in an erected state.

As described above, while the present invention has been particularly shown and described with reference to the example embodiments thereof, it will be understood by those of ordinary skill in the art that the above embodiments of the present invention are all exemplified and various changes, modifications and equivalents may be made therein without changing the essential characteristics and scope of the present invention. Therefore, it would be understood that the embodiments disclosed in the present invention are not to limit the technical idea of the present invention but to describe the present invention, and the technical and protective scope of the present invention shall be defined by the illustrated embodiments. It should be also understood that the protective scope of the present invention is interpreted by the following claims and all technical ideas within the equivalent scope belong to the technical scope of the present invention.

According to an embodiment of the present invention, the total-body exerciser can make the human body's waist, abdomen and knee joints flexible and strengthening muscular strength. Additionally, the total-body exerciser can strengthen muscular strength, remove abdominal fat, strengthen flexibility and functions of internal organs, and enhance mental relaxation effect so as to solve the problems of degenerative lumbar disk diseases of the middle-aged and the old-aged, scoliosis due to bad life habits, fascial pains in the hip joint and waist parts, and degeneration in growth due to stress of adolescent generation.

The invention claimed is:

1. A total-body exerciser comprising:

an upper body exercising part which comprises an upper body support for supporting the upper body of a human body, a mat fixing plate disposed at an upper face of the upper body support, a link disposed at one side of a lower face of the upper body support, a rotary shaft disposed at the lower face of the upper body support for a seesaw motion, a crank cam rod disposed between the link and a driven shaft pulley, a main shaft pulley connected to the driven shaft pulley by a power transmission unit, and a driving shaft pulley connected to the main shaft pulley and a motor by the power transmission part; and a waist and hip exercising part which comprises a hip support for supporting hips, a height-adjustable cylinder connected to a lower end of the hip support, a guide connected to an upper face of the hip support, a rail disposed at an upper carrying support enabling a parallel movement of the guide, a power transmission motor for the parallel movement, a reciprocating rotational crank rod connected to a lower end of the height-adjustable cylinder via a cam rod bracket, a cam of which one end is connected to the reciprocating rotation crank rod and of which the other end is connected to the main shaft pulley through the rotary shaft, and a pulley bracket of which one end is connected to the main shaft pulley through the rotary shaft and of which the other end is fixed to a lower end of a main frame.

2. The total-body exerciser according to claim 1, further comprising:

a leg exercising part which comprises a lower massaging roller serving to support the legs and provide a massaging function, an upper massaging roller which comes into contact with upper portions of the legs in order to massage the legs together with the lower massaging roller and which is mounted on an upper massaging roller support, a leg support post for supporting the lower massaging roller, a reciprocating link rod connected to a lower end of the leg support post, rotational cams connected to right and left sides of the reciprocating link rod, a fixing bracket of which one end is connected with the rotational cam via the rotary shaft and of which the other end is fixed to a lower end of the main frame, and a cam of which one end is connected to one end of the fixing bracket via the rotary shaft and of which the other end is connected with the reciprocating rotational crank rod.

3. The total-body exerciser according to claim 1, further comprising:

an ankle exercising part which comprises an ankle support mat for supporting ankles, an ankle rotating plate support for holding the ankle support mat, a rotary shaft fixing plate connected with the ankle rotating plate support by a rotary shaft, and a rotation stopping bar adapted to prevent that the ankle support mat is completely rotated and falls backward to the opposite side by the ankle rotating plate support in the state where a user lays down on the exerciser.

4. The total-body exerciser according to claim 1, wherein a gripper fixing bracket having a gripper is connected to one end of the mat fixing plate, and an auxiliary waist support is connected to the other end of the mat fixing plate and is also connected with the hip support.

* * * * *